US009163468B2

(12) United States Patent
Whiddon

(10) Patent No.: US 9,163,468 B2
(45) Date of Patent: Oct. 20, 2015

(54) EXPANDABLE CASING PATCH

(75) Inventor: Richard Murray Whiddon, Katy, TX (US)

(73) Assignee: Enventure Global Technology, LLC, Houston, TX (US)

( * ) Notice: Subject to any disclaimer, the term of this patent is extended or adjusted under 35 U.S.C. 154(b) by 450 days.

(21) Appl. No.: 13/880,594

(22) PCT Filed: Oct. 18, 2011

(86) PCT No.: PCT/US2011/056659

§ 371 (c)(1),
(2), (4) Date: Apr. 22, 2013

(87) PCT Pub. No.: WO2012/054445

PCT Pub. Date: Apr. 26, 2012

(65) Prior Publication Data

US 2013/0206426 A1 Aug. 15, 2013

Related U.S. Application Data

(63) Continuation of application No. 12/910,579, filed on Oct. 22, 2010, now abandoned.

(51) Int. Cl.
*E21B 29/10* (2006.01)
*E21B 43/10* (2006.01)

(52) U.S. Cl.
CPC ..... *E21B 29/10* (2013.01); *E21B 43/103* (2013.01); *E21B 43/105* (2013.01); *E21B 43/106* (2013.01); *E21B 43/108* (2013.01)

(58) Field of Classification Search
CPC ... E21B 43/103; E21B 43/106; E21B 43/105; E21B 43/108
See application file for complete search history.

(56) References Cited

U.S. PATENT DOCUMENTS

| | | | |
|---|---|---|---|
| 2,812,025 | A | 11/1957 | Doherty et al. |
| 3,948,321 | A | 4/1976 | Owen et al. |
| 4,660,863 | A | 4/1987 | Bailey et al. |
| 5,404,955 | A | 4/1995 | Echols et al. |
| 5,437,340 | A | 8/1995 | Lee et al. |

(Continued)

OTHER PUBLICATIONS

International Report of Patentability and Written Opinion dated Apr. 23, 2013 for corresponding International Application No. PCT/US2011/056659 (6 pgs.).

(Continued)

*Primary Examiner* — Jennifer H Gay
*Assistant Examiner* — George Gray
(74) *Attorney, Agent, or Firm* — Derek V. Forinash; Porter Hedges LLP

(57) ABSTRACT

A system including a housing having an upper end in fluid communication with a source of pressurized fluid and a lower end releasably coupled to an expandable tubular. A piston is disposed within and sealingly engaged with the housing. An expansion cone is coupled to the piston and is operable to radially expand the expandable tubular as it moves longitudinally therethrough. A pressure chamber is disposed within the housing and defined by the piston and the expansion cone. A first pressure relief port is disposed within the housing and is operable to allow fluid communication between the pressure chamber and an annulus external to the housing. A second pressure relief port is disposed within the expansion cone and is operable to allow fluid communication between the pressure chamber and a portion of the expandable tubular below the expansion cone.

18 Claims, 5 Drawing Sheets

(56) References Cited

U.S. PATENT DOCUMENTS

| | | | |
|---|---|---|---|
| 5,507,343 | A | 4/1996 | Carlton et al. |
| 5,785,120 | A | 7/1998 | Smalley et al. |
| 5,833,001 | A | 11/1998 | Song et al. |
| 6,142,230 | A | 11/2000 | Smalley et al. |
| 6,854,521 | B2 | 2/2005 | Echols et al. |
| 7,048,067 | B1 | 5/2006 | Cook et al. |
| 7,063,142 | B2 | 6/2006 | Cook et al. |
| 7,066,259 | B2 | 6/2006 | Duggan et al. |
| 7,100,684 | B2 | 9/2006 | Cook et al. |
| 7,255,177 | B2 | 8/2007 | Duggan et al. |
| 7,258,168 | B2 | 8/2007 | Cook et al. |
| 7,493,946 | B2 | 2/2009 | Filippov et al. |
| 7,543,639 | B2 | 6/2009 | Emerson |
| 2003/0116325 | A1 | 6/2003 | Cook et al. |
| 2003/0121655 | A1 | 7/2003 | Lauritzen et al. |
| 2003/0141074 | A1 | 7/2003 | Freeman |
| 2003/0178204 | A1* | 9/2003 | Echols ..... E21B 33/12 166/386 |
| 2004/0154808 | A1 | 8/2004 | Simpson et al. |
| 2004/0159445 | A1 | 8/2004 | Hazel et al. |
| 2004/0244968 | A1 | 12/2004 | Cook et al. |
| 2005/0161226 | A1 | 7/2005 | Duggan et al. |
| 2007/0000664 | A1 | 1/2007 | Ring et al. |
| 2007/0051514 | A1 | 3/2007 | La Rovere |
| 2007/0107898 | A1 | 5/2007 | Baycroft et al. |
| 2007/0151725 | A1 | 7/2007 | Cook et al. |
| 2007/0163786 | A1 | 7/2007 | Sivley, IV |
| 2007/0272418 | A1 | 11/2007 | Corre et al. |
| 2008/0202753 | A1 | 8/2008 | Harrall et al. |
| 2009/0188569 | A1 | 7/2009 | Saltel |
| 2009/0229835 | A1 | 9/2009 | Filippov et al. |

OTHER PUBLICATIONS

Search Report dated May 14, 2012 for corresponding International Application No. PCT/US2011/056659 (3 pgs.).

Office Action dated Nov. 2, 2011 from corresponding U.S. Appl. No. 12/910,579 (17 pgs.).

* cited by examiner

EXPANDABLE CASING PATCH

CROSS-REFERENCE TO RELATED APPLICATIONS

This application claims priority to U.S. patent application Ser. No. 12/910,579, filed Oct. 22, 2010. This priority application is incorporated herein in its entirety, to the extent consistent with the present application.

BACKGROUND

This disclosure relates generally to the construction, maintenance, and repair of wellbore tubular strings to facilitate hydrocarbon production or downhole fluid injection.

When an opening is formed in the sidewalls of an existing wellbore casing, whether through damage to the casing or because of an intentional perforation of the casing, it is often necessary to repair the opening in the existing wellbore casing. Conventional methods of repairing such openings can create unacceptable restrictions in the wellbore or fail to provide the necessary performance requirements once they are installed.

The principles of the present disclosure are directed to overcoming one or more of the limitations of the existing apparatus and processes for repairing openings in existing casing.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
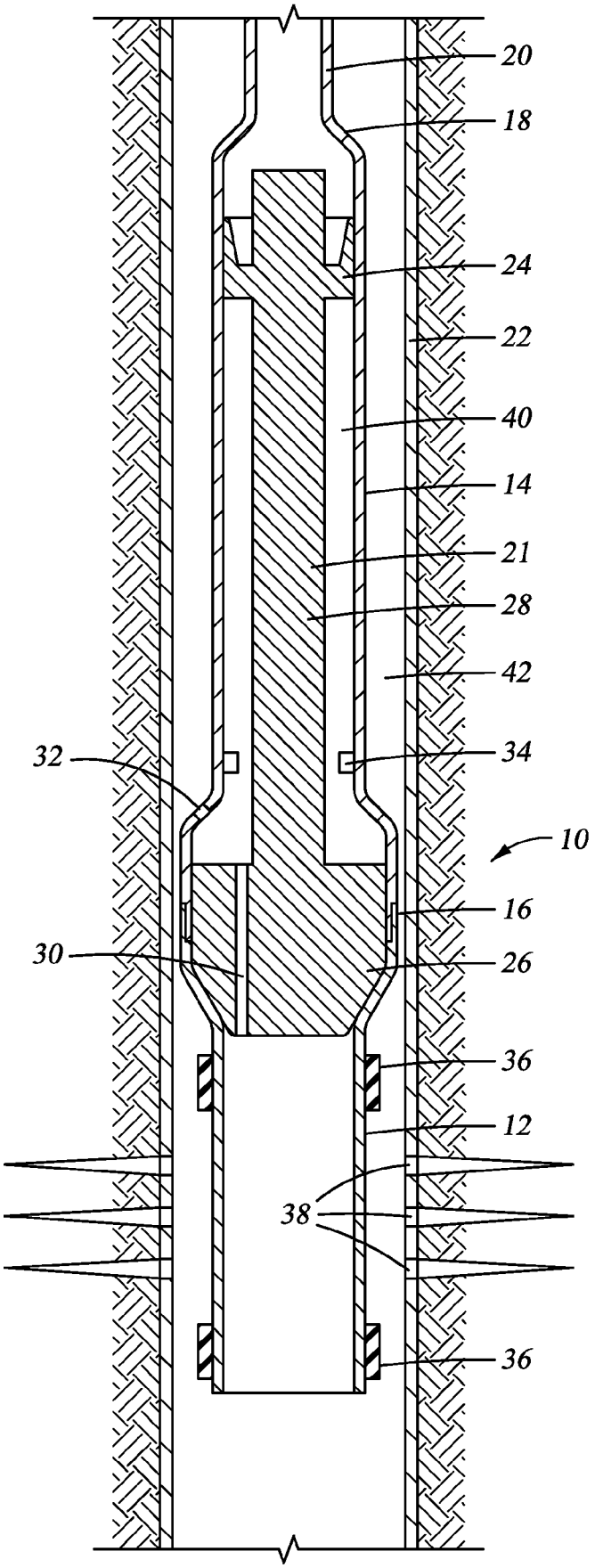
FIG. 1 is a schematic, partial section view of one embodiment of a system for repairing casing shown in an initial position.

In the drawings and description that follow, like parts are typically marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The terms "pipe," "tubular member," "casing" and the like as used herein shall include tubing and other generally cylindrical objects. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, casing repair system 10 comprises an expandable tubular 12 coupled to a housing 14 by a releasable connection 16. Housing 14 has an upper end 18 that is coupled to a fluid conduit 20 that supplies pressurized fluid to system 10. Fluid conduit 20 may be a drill pipe, coiled tubing, wireline-run pump, or other system operable to support system 10 within the wellbore casing 22 and provide pressurized fluid to the system. Expandable tubular 12 includes sealing members 36 that are operable to sealingly engage wellbore casing 22 after the tubular is expanded.

Patch system 10 also comprises expansion assembly 21 comprising piston 24, expansion cone 26, and mandrel 28. Piston 24 is disposed within and sealingly engaged with housing 14. Piston 24 is coupled to cone 26 by mandrel 28. Cone 26 is disposed partially within expandable tubular 12 and is operable to radially expand tubular 12 as the cone moves longitudinally therethrough. Cone 26 has a pressure relief port 30 that allows fluid communication across the cone. Housing 14 also includes a pressure relief port 32 that provides fluid communication across the housing and mandrel stop 34 that limits the movement of mandrel 28 relative to the housing.

In operation, system 10 is lowered into wellbore casing 22 until sealing members 36 are located on either said of casing penetrations 38. Once in the desired location, fluid conduit 20 supplies pressurized fluid to the upper end 18 of housing 14. The pressurized fluid applied to piston 24 causes the piston, mandrel 28, and expansion cone 26 to move longitudinally relative to housing 14. This motion causes expansion cone 26 to move longitudinally through expandable tubular 12, which causes the tubular to be radially expanded.

As piston 24 moves through housing 14, fluid within pressure chamber 40, defined by the piston and expansion cone 26, is expelled through relief port 32 into annulus 42. Pressure relief port 30 allows fluid trapped below expandable tubular 12 to flow into pressure chamber 40 and out into annulus 44 through relief port 32. As expansion cone 26 moves longitudinally through and radially expands expandable tubular 12, sealing members 36 are also radially expanded into sealing engagement with wellbore casing 22.

Figure 2:
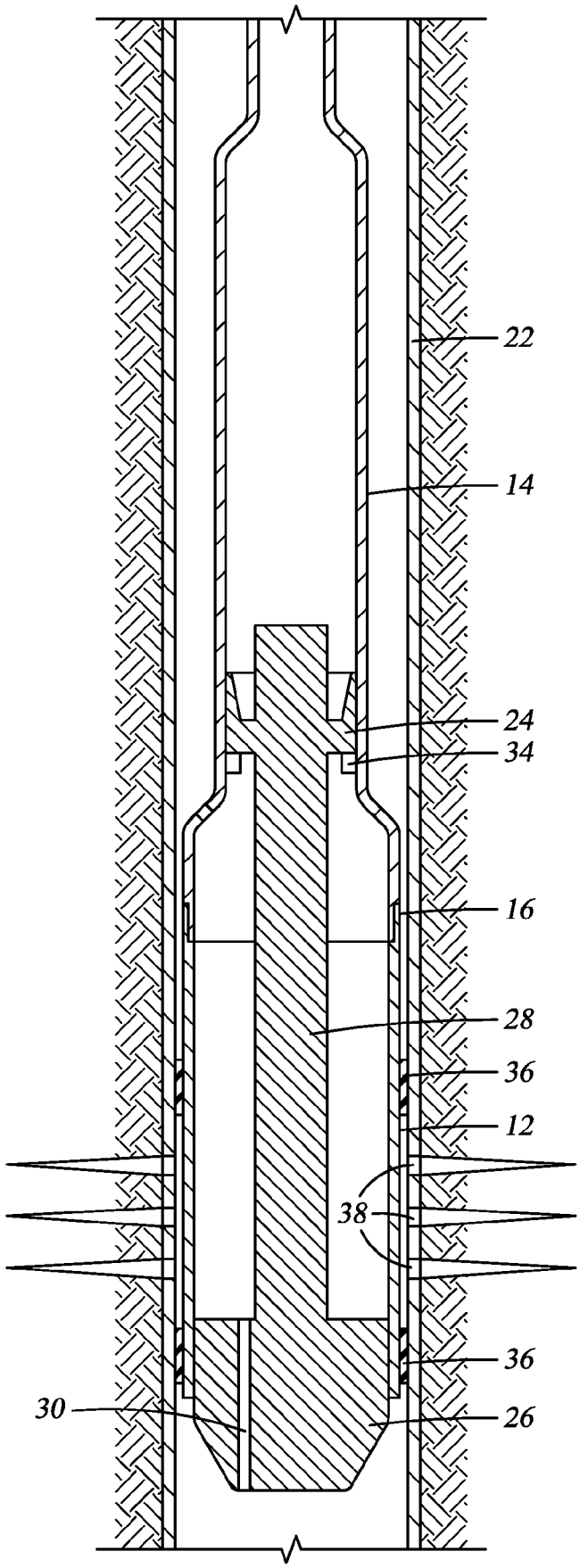
FIG. 2 is the system of FIG. 1 shown in an expanded position.
Figure 3:
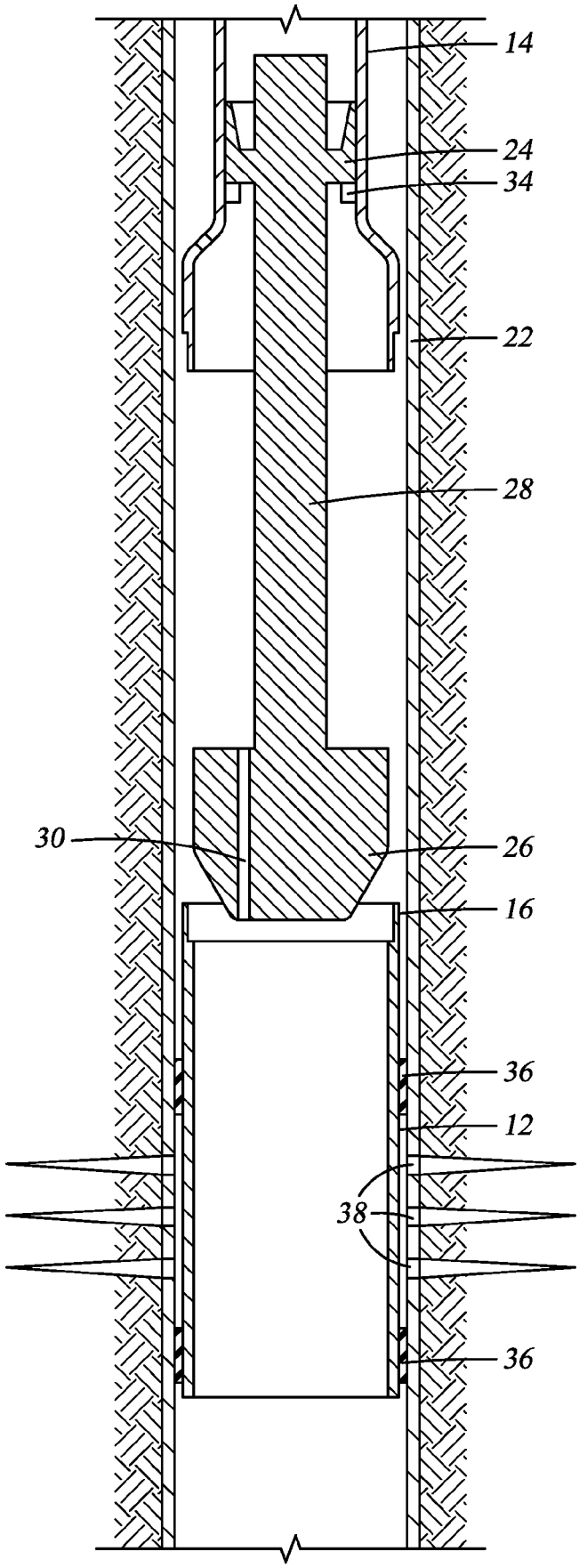
FIG. 3 illustrates the wellbore as repaired by the system of FIG. 1.

Referring now to FIG. 2, expansion cone 26 has fully expanded expandable tubular 12. The motion of expansion cone 26 is stopped when piston 24 reaches mandrel stop 34. Sealing members 36 are engaged with wellbore casing 22, hydraulically isolating casing penetrations 38 from the wellbore. Once, expandable tubular 12 has been fully expanded releasable connection 16 can be disconnected, such as by rotating housing 14 relative to tubular 12. Disconnecting releasable connection 16 allows expandable tubular 12 to separate from housing 14. Housing 14, along with piston 24, expansion cone 26, and mandrel 28 can be retrieved from the wellbore, leaving expandable tubular in place, as is shown in FIG. 3.

Figure 4:
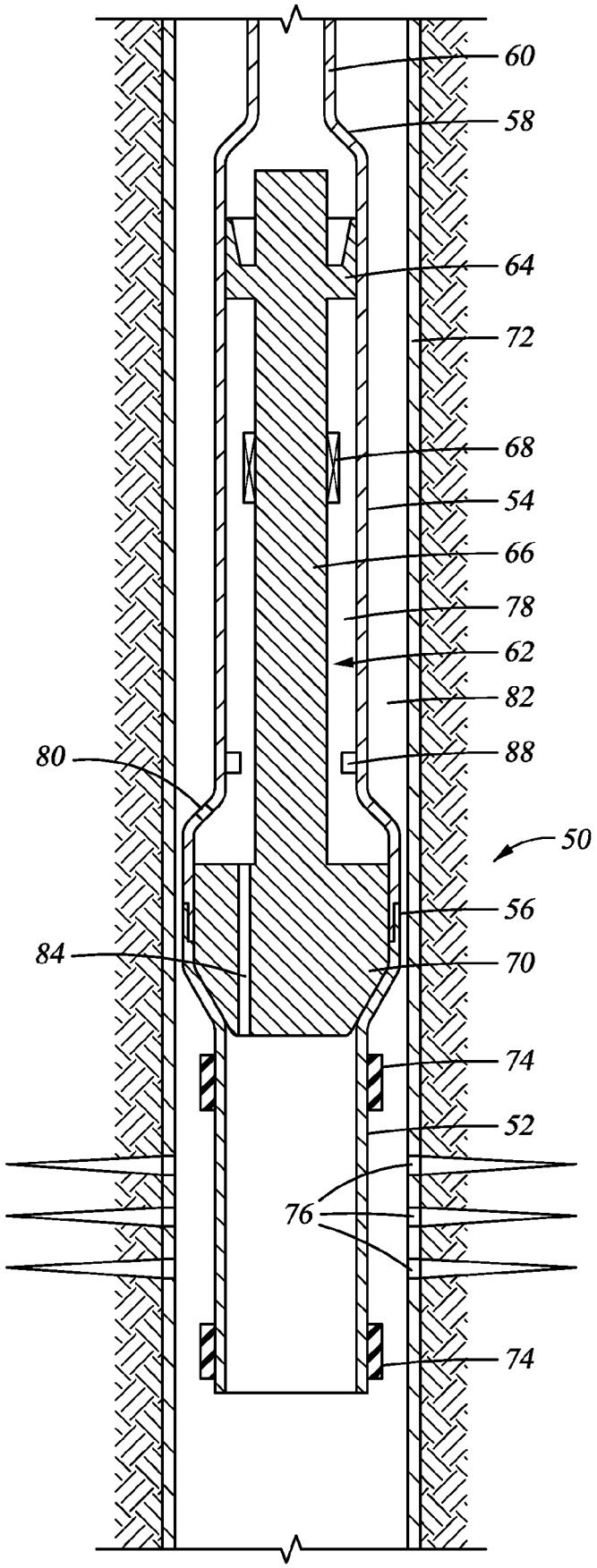
FIG. 4 is a schematic, partial section view of an alternative embodiment of a system for repairing casing shown in an initial position.
Figure 5:
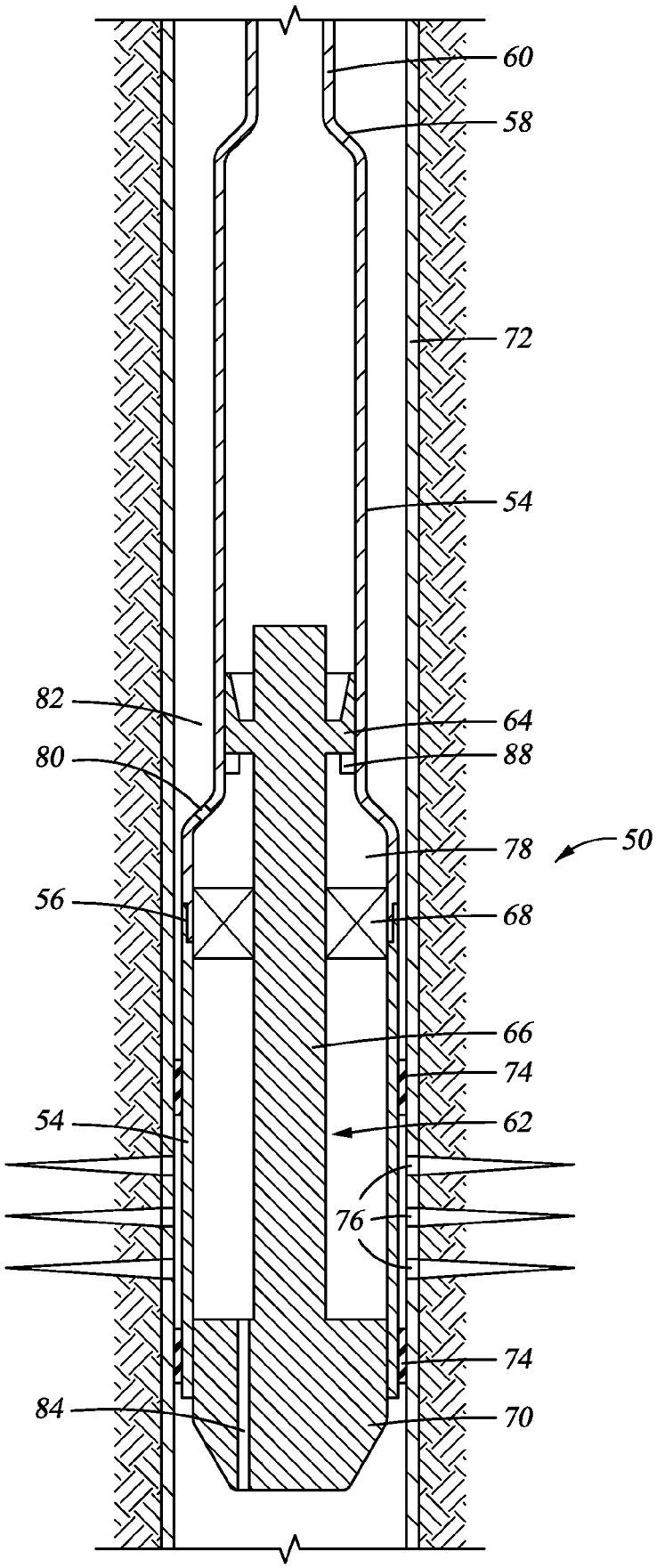
FIG. 5 is the system of FIG. 4 shown in an expanded position.

Referring now to FIGS. 4 and 5, casing repair system 50 comprises an expandable tubular 52 coupled to a housing 54 by a releasable connection 56. Housing 54 has an upper end 58 that is coupled to a fluid conduit 60 that supplies pressurized fluid to system 50. System 50 also comprises an expansion assembly 62 including a piston 64, mandrel 66, connection latch 68, and expansion cone 70. Connection latch 68 is operable to engage releasable connection 56 and disengage expandable tubular 52 from housing 54 once the connection latch is disposed adjacent to the releasable connection, as is shown in FIG. 5.

In operation, casing repair system 50 is positioned in wellbore 72 using drillpipe, coiled tubing, wireline, or other conveyance devices as are know in the art. Casing repair system 50 may be positioned in wellbore 72 so that seal members 74 are disposed on either side of casing penetrations 76. Once in system 50 is in position, pressurized fluid is supplied to housing 54 by conduit 60. The pressurized fluid can be supplied by pumps at the surface or by a pump run into the wellbore.

The pressurized fluid in housing 54 causes piston 64, mandrel 66, latch 68, and expansion cone 70 to move longitudinally relative to housing 54. This motion causes expansion cone 70 to move longitudinally through and radially expand expandable tubular 52. As piston 64 moves through housing 54, fluid within pressure chamber 78, defined by the piston and expansion cone 70, is expelled through relief port 80 into annulus 82. Pressure relief port 84 allows fluid trapped below expandable tubular 52 to flow into pressure chamber 78 and out into annulus 82 through relief port 80. As expansion cone 70 moves longitudinally through and radially expands expandable tubular 52, sealing members 74 are also radially expanded into sealing engagement with wellbore casing 86, as is shown in FIG. 5.

Referring still to FIG. 5, expansion cone 70 has fully expanded expandable tubular 52. The motion of expansion assembly 62 is stopped when piston 64 reaches mandrel stop 88. In certain embodiments, the engagement of connection latch 68 and releasable connection 54 may alternatively stop the motion of expansion assembly 62. Sealing members 74 are engaged with wellbore casing 86, hydraulically isolating casing penetrations 76 from the wellbore. Connection latch 68 engages releasable connection 56 and disconnects expandable tubular 52 from housing 54. Housing 54, along with expansion assembly 62 can be retrieved from the wellbore, leaving expandable tubular 52 in place.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A system comprising:

a housing having an upper end in fluid communication with a source of pressurized fluid, the housing having an upper end of a first diameter and an enlarged lower end of a second diameter lamer than the first;

an expandable tubular having a lower end of a first diameter and an enlarged upper end of a second diameter lamer than the first releasably coupled to the lower end of the housing;

a piston sealingly disposed within the housing so that the pressurized fluid is contained within the housing;

a mandrel coupled to the piston and extending toward the lower end of the housing;

an expansion cone coupled to the mandrel, wherein the expansion cone has an expansion diameter that radially expands the expandable tubular as the expansion cone moves longitudinally therethrough, wherein the expansion cone is configured to pass through the enlarged upper end of the expandable tubular without expanding the upper end, the piston, mandrel and expansion cone moving together in response to the pressurized fluid being applied to the piston;

a first pressure relief port disposed in the lower end of the housing and providing fluid communication across the housing; and a second pressure relief port disposed in the expansion cone and providing fluid communication across the expansion cone, wherein both the first and second pressure relief ports provide fluid communication as the expansion cone radially expands the expandable tubular.

2. The system of claim 1 further comprising a mandrel stop disposed within the housing and operable to limit longitudinal movement of the mandrel.

3. The system of claim 1 further comprising a seal assembly coupled to an outer surface of the expandable tubular.

4. The system of claim 1 further comprising a connection latch coupled to the piston, wherein the connection latch is operable to release the expandable tubular from the housing.

5. The system of claim 1 wherein the housing is released from the expandable tubular by rotation of the housing relative to the expandable tubular.

6. A system comprising:

an expandable tubular having a lower end of a first diameter and an enlarged upper end of a second diameter lamer than the first;

a housing coupled to the enlarged upper end of the expandable tubular by a releasable connection, the housing having an upper end of a first diameter and an enlarged lower end of a second diameter lamer than the first;

a piston disposed within and sealingly engaged with the housing;

a mandrel extending from the piston toward the expandable tubular;

an expansion cone coupled to the mandrel and having an expansion diameter sized so as to radially expand the expandable tubular as the expansion cone moves longitudinally therethrough, the piston, mandrel and expansion cone moving together in response to the pressurized fluid being applied to the piston; and a first pressure relief port disposed through a wall of the housing; and a second pressure relief port disposed through the expansion cone;

wherein the first and second pressure relief ports provide fluid communication as the expansion cone radially expands the expandable tubular.

7. The system of claim 6 further comprising a mandrel stop disposed within the housing and operable to limit longitudinal movement of the mandrel.

8. The system of claim 6 further comprising a seal assembly coupled to an outer surface of the expandable tubular.

9. The system of claim 6 further comprising a connection latch coupled to the piston, wherein the connection latch is operable to release the expandable tubular from the housing.

10. The system of claim 6 wherein the housing is released from the expandable tubular by rotation of the housing relative to the expandable tubular.

11. A method comprising:

constructing an expansion system by coupling an expandable tubular to a housing with a releasable coupling and disposing an expansion cone at least partially within the expandable tubular, wherein the expansion cone is coupled to a piston sealingly engaged with the housing;

disposing the expansion system in a wellbore;

applying a pressurized fluid to the piston so as to move the expansion cone longitudinally through the expandable tubular and radially expand the expandable tubular into engagement with the wellbore, wherein the pressurized fluid is not applied to either the expansion cone or the expandable tubular;

equalizing fluid pressure across the expansion cone and across the expandable tubular while the pressurized fluid is applied to the piston;

releasing the expandable tubular from the housing; and retrieving the housing, the expansion cone, and the piston from the wellbore.

12. The method of claim 11 wherein the housing includes a first pressure relief port that equalizes fluid pressure across the expandable tubular.

13. The method of claim 12, wherein the expansion cone includes a second pressure relief port that equalizes pressure across the expansion cone.

14. The method of claim 11 further comprising stopping the longitudinal movement of the expansion cone once the expandable tubular is fully expanded.

15. The method of claim 11 wherein the longitudinal movement of the expansion cone is stopped by the piston engaging a mandrel stop disposed within the housing.

16. The method of claim 11 wherein the longitudinal movement of the expansion cone is stopped when a connection latch coupled to the expansion cone engages the releasable coupling.

17. The method of claim 11 wherein the expandable tubular is released from the housing by rotating the housing relative to the expandable tubular.

18. The method of claim 11 wherein the expandable tubular is released from the housing by a connection latch engaging with the releasable coupling.

* * * * *